United States Patent [19]

Lisiecki et al.

[11] Patent Number: 4,911,306

[45] Date of Patent: Mar. 27, 1990

[54] FLAT TOP END CLOSURE FOR LIQUID CONTAINERS

[75] Inventors: Robert E. Lisiecki, West Bloomfield; Howard E. Murrah, Fenton, both of Mich.

[73] Assignee: Elopak Systems A. G., Glattbrugg, Switzerland

[21] Appl. No.: 340,280

[22] Filed: Apr. 19, 1989

Related U.S. Application Data

[63] Continuation of Ser. No. 64,670, Jun. 22, 1987, abandoned.

[51] Int. Cl.[4] ..... B65D 5/74

[52] U.S. Cl. ..... 206/631.2; 229/137

[58] Field of Search ..... 229/137, 138, 125.42; 206/621, 621.3, 625, 626, 628, 631.2

[56] References Cited

U.S. PATENT DOCUMENTS

| | | | |
|---|---|---|---|
| 2,151,202 | 3/1939 | Guyer | 229/17 R |
| 3,107,038 | 10/1963 | Kuchenbecker | 229/17 R |
| 3,333,758 | 8/1967 | Buchner | 229/17 R |
| 4,546,884 | 10/1985 | Kuchenbecker | 229/17 R |

*Primary Examiner*—Gary Elkins

*Attorney, Agent, or Firm*—John P. Moran

[57] ABSTRACT

There is disclosed herein a flat top end closure for a liquid carrying container, which includes two oppositely disposed, overlapped outer closure panels, and two oppositely disposed, fold-in panels, one of which cooperates to form the flat top configuration when closed, but serves as a substantially longer pour spout when opened by virtue of incorporating the top portion of the front wall panel as a part thereof. First and second lift tabs are formed on the edges of one of the outer closure panels and the pour spout fold-in panel, respectively. Diagonal opening-assist score lines are formed on the outer closure panels and on a portion of the side wall panels adjacent the pour spout.

4 Claims, 3 Drawing Sheets

FLAT TOP END CLOSURE FOR LIQUID CONTAINERS

This is a continuation of Ser. No. 064,670, filed 6/22/87, now abandoned.

Technical Field

This invention relates generally to thermoplastic coated paperboard containers for carrying liquids and blanks for constructing same and, more particularly, to an improved, easy openable flat top end closure therefor.

BACKGROUND ART

Containers for beverages such as milk and juices are conventionally constructed from thermoplastic coated paperboard. One common type of these containers includes a top end closure with a folded gable roof having a vertically projecting sealed fin at the roof ridge for sealing the container. Such containers are shown by U.S. Pat. No. 3,270,940. The bottom end closure for same is conventionally of the infolded type, such as that shown by U.S. Pat. No. 3,120,335.

Another type of container includes a slant top or a flat top end closure wherein what could otherwise be a vertically projecting sealed find, or a slanted sealed fin, may be folded flat and releasably secured to the rest of the closure. U.S. Pat. Nos. 3,869,078 and 4,211,357 disclose such slant and/or flat top closures.

Various techniques have been employed to enhance the folding of a sealed fin in one particular direction to facilitate packing the containers in layers on top of each other to minimize storage and cargo space, without requiring any shipping tray between layers. For example, in U.S. Pat. No. 4,078,715 there is disclosed a top end closure with an inclined sealed fin that includes a "harder crease" on one side thereof than on the other for facilitating folding of the sealed fin from a vertical position to the inclined position.

U.S. Pat. Nos. 4,012,997 and 4,093,115 disclose a container folding method and the container made by the method, wherein one side of the gable panels of the top end closure is provided with double score lines extending parallel to each other. Folding of a sealed top fin of the end closure from a vertical position to a flat position requires the application of a downward force against the outside panel to bend the sealed fin downwardly.

In U.S. Pat. No. 4,206,867, a wide score line is formed on one side of the gable panels, in lieu of the above mentioned double score lines, with a conventional score line of the opposite side providing unequal fold-back panels.

In the above-mentioned U.S. Pat. No. 4,211,357, unequal angles at the base of the infolded gable or gusset panels, with or without lower score lines on one side thereof than on the other, enhance folding in the direction of the larger base angles. In an alternative embodiment, a lowered and/or inclined wide score line provide the inclination to slant in one direction.

U.S. Pat. No. 4,422,570 is an example of an improved flat top end closure for a liquid carrying, paperboard container wherein the sealed fin previously used in conjunction with flat end closures is not required, but wherein a pitcher pour spout is included. An external lift tab is integrally formed on one outer closure panel for initial lifting of a portion of the pitcher pour spout, and an underlying lift tab is formed on one fold-back closure panel of another portion of the pitcher pour spout, in order to facilitate the opening process.

In liquid carrying paperboard container constructions generally, for sensitive food products, such as mil or fruit juice, it is essential that the top closure be thoroughly sealable so as to be clean and sanitary and yet be functional from the standpoint of including means for readily opening the pouring spout thereof. As illustrated and described in the above-mentioned U.S. Pat. No. 3,270,940, anti-adhesive or "abhesive" patterns have been utilized, primarily on one or both sides of the rib panels located outward of the infolded triangular fold-back panels and inward of the outer edge sealing flaps. In the flat top structure disclosed in the above-mentioned U.S. Pat. No. 4,422,570, wherein there is no conventional sealing fin, such as the usual rib panels and sealing flaps, arrangements such as shown and described in U.S. Pat. No. 4,582,246 for releasably sealing the top closure are required.

DISCLOSURE OF THE INVENTION

A general object of the invention is to provide an improved pouring spout for a flat end closure for a liquid carrying, paperboard container.

A further object of the invention is to provide an improved flat top end closure, including one set of diagonal score lines to facilitate closing the top closure, and a second set of longer diagonal score lines which extend a predetermined distance down the front wall panel to form a longer pouring spout having a less severe carton tilt angle with an effective venting characteristic when the carton is opened.

A further object of the invention is to provide a flat top end closure for a container, including two oppositely disposed outer closure panels which are adapted to lie flat on top of the underlying fold-in panels and wherein one is longer and overlaps the edge portion of the other shorter one, with the longer one including a lift tab for lifting a portion of the pour spout from its flat attitude during the opening process, and two oppositely disposed, three-segment fold-in panels, one of which serves as the pour spot when opened and includes a lift tab on one of its segments for first lifting a portion of the pour spout during the opening process and a supplementary diagonal score line arrangement for providing an improved pouring spout.

Still another object of the invention is to provide the above described flat top end closure wherein the supplementary diagonal score line arrangement includes a horizontal score line across the front panel a distance below the three-segment fold-in pour spout panel approximately equal to the height of the latter panel, and two diverging score lines extending upwardly from each of the ends of the lower horizontal score line.

These and other objects and advantages of the invention will be apparent when reference is made to the following description and accompanying drawings.

BEST MODE FOR CARRYING OUT THE INVENTION

Figure 1:
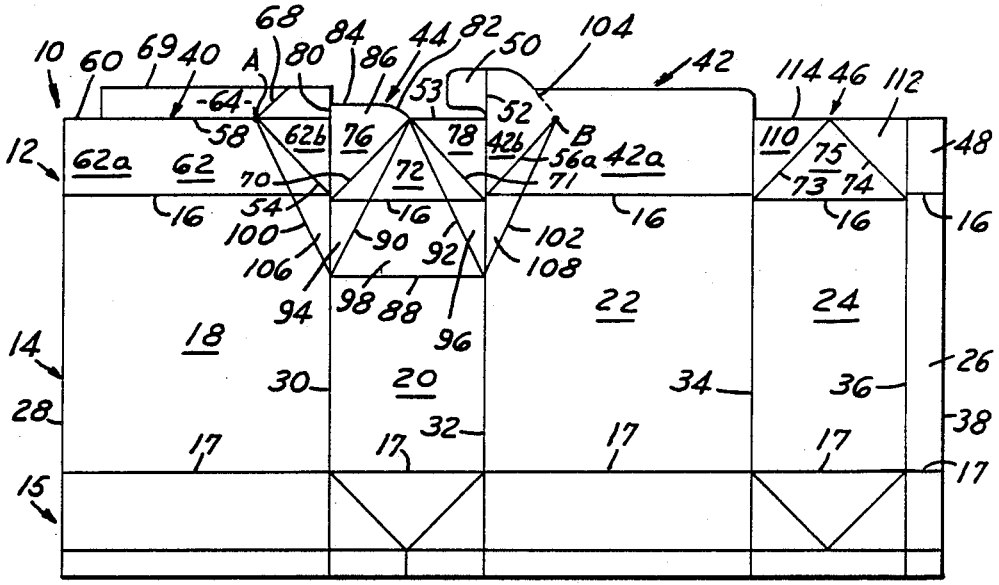
FIG. 1 is a layout view of a blank from which the top end closure of the invention is formed, showing the outside surface thereof.

Referring now to the drawings in greater detail, FIG. 1 illustrates the outside surface of blank 10 including a top closure portion 12, a body portion 14, and a bottom closure portion 15. The portions 12 and 14 are separated by a staggered horizontal score line 16, and the portions 14 and 15 are separated by a horizontal score line 17. The body portion 14 includes a first side panel 18, a front panel 20, a second side panel 22, a back panel 24, and a narrow fifth panel or side seam 26. The panels 18, 20, 22, 24 and 26 are defined, respectively, by a first free cut edge 28, vertical score lines 30, 32, 34, and 36, and a second free cut edge 38.

A pair of outer top closure panels 40 and 42 are integrally connected to the first and second side panels 18 and 22, respectively, at the score line 16. A pair of fold-in top panels 44 and 46 are integrally connected to the front and back panels 20 and 24, respectively, at the score line 16. The top panels are integrally connected to each other by the above-mentioned vertical score lines. An end closure extension 48 of the side seam 26 is integrally connected to the latter at the score line 16 and to the fold-in panel 46 at the score line 36. The panel 44 will serve as a pour spout, as will be explained.

A lift tab 50 is formed on the upper edge portion of the top panel 42 so as to be integrally connected thereto by a score line 52, substantially an extension of the vertical score line 32, extending laterally and substantially parallel to a portion of the free cut edge 3 of the panel 44.

Figure 1A:
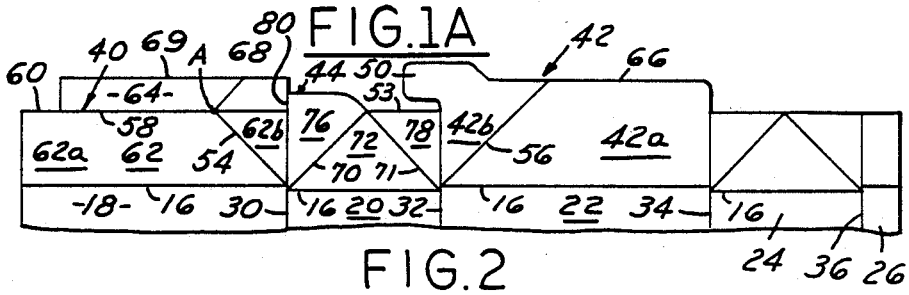
FIG. 1A is a fragmentary layout view of a blank similar to FIG. 1, showing a prior art arrangement thereof.

As shown in the prior art FIG. 1A, opening-assist diagonal score lines 54 and 56 are formed on the outer top panels 40 and 42, respectively. The line 54 extends substantially from the intersection of the vertical score line 30 and the horizontal score line 16 to a point A on a horizontal score line 58 formed across the panel 40. The score line 58 terminates in a free cut edge 60, and divides the panel 40 into segments 62 and 64, while the diagonal score line 54 divides the panel 62 into segments **62*a* and 62*b*. The score line 56 extends from the intersection of the score lines 32 and 16 to the free cut edge 66 of the panel 42, dividing the panel 42 into segments 42*a* and 42*b*, the lift tab 50 extending from the segment 42*b*. A diagonal score line 68 is formed across the panel 64 from the end of the diagonal score line 54 at point A on the score line 58, to the free cut edge 69 of the panel 64. The score lines 54 and 56 are not used on the blank illustrated in the preferred embodiment of FIG. 1**, but have been replaced by other score lines, as will be explained.

On both FIGS. 1 and 1A, a pair of converging diagonal score lines 70 and 71 are formed on the fold-in top panel 44 so as to form with the horizontal score line 16 a triangular panel portion 72 adjacent the upper edge of the body back panel 20. Likewise, a pair of converging diagonal score lines 73 and 74 are formed on the fold-in top panel 46 so as to form with the horizontal score line 16 a triangular panel portion 75 adjacent the upper edge of the body front panel 24. The score lines 70, 71, 73 and 74 may be spaced at their lower ends slightly inward from the respective adjacent vertical score lines 30, 32, 36 and 34 along the horizontal score line 16 to compensate for paperboard thickness for more accurate top folding characteristics, if desired, but may intersect the junctures of score lines 30 and 16, 32 and 16, 36 and 16, and 34 and 16, respectively, as shown.

The score lines 70 and 71 on the panel 44 have also defined a pair of fold-back panel portions consisting of a panel portion 76 between the score lines 70 and 30, a panel portion 78 between the score lines 71 and 32. It may be noted in FIG. 1A that the free cut edge 53 of the panel portion 78 is substantially aligned with the score line 58 and the edge 60, at the apex of the triangular panel portion 72.

The fold-back panel portion 76 extends beyond the score line 58 and the apex of the triangular panel portion 72, such that it includes a short vertical edge 80 separated by a cut from the panel segment 64 and aligned with the vertical score line 30, a short free cut edge 82 substantially aligned with the diagonal score line 71, and a lateral free cut edge 84 extending between the outer ends of the edges 80 and 82. Thus, the panel portion 78 is substantially triangular in shape, defined by the score lines 32 and 71 and the edge 53, while the panel portion 76 is substantially four-sided in shape, defined by the score lines 30 and 70 and the edges 80, 82 and 84. The portion 86 of the panel portion 76 which extends beyond the aligned score lines 53 and 58 serves as a second lift tab, as will be explained.

In addition to the diagonal opening-assist score lines 70, 71 and 54 of the prior art FIG. 1A, the prior score line 56 has been shortened (hereinafter **56*a*), and a plurality of supplemental score lines have been utilized to provide an improved spout opening and pouring action. Specifically, a horizontal score line 88 has been formed across the width of the front wall panel 20, positioned below the score line 16 a distance approximately equal to the height of the triangular top closure panel 72. Diagonal score lines 90 and 92 are formed to extend from the respective ends of the horizontal score line 88, across the horizontal score line 16, to the apex of the triangular panel 72, where the diagonal score lines 70 and 71 converge. The diagonal score line 90 defines with the score lines 30 and 70 a triangular segment 94, while the score line 92 defines with the score lines 32 and 71 a triangular segment 96. There is also defined a triangular segment 98 at the top of the front panel 20 and extending across the central portion of the triangular panel portion 72. The score lines 88, 90 and 92 form the triangular segment 98**.

A pair of diagonal score lines 100 and 102 are formed to extend from the respective junctures of the horizontal score line 8 with the diagonal score lines 90 and 92, across portions of the panels 18 and 62 to the score line 58 of the shorter outer closure panel 40 at the point A where the prior score line 54 had terminated and to a point B on the longer outer closure panel 42 symmetrical in FIG. 1 to the location of the point A. A perforated line 104 extends in a reverse diagonal direction from the point B to the free edge of the longer outer closure panel 42. It is at the point B where the shortened score line 56*a* terminates.

The score line 100 serves to divide the panel 62 into segments 62*a* and 62*b*. The segment 62*b* is an extension of a triangular segment 106 formed on the corner of the side panel 18. The score line 102 and the perforated line 104 divide the panel 42 into segments 42*a* and 42*b*. The segment 42*b* is an extension of a triangular segment 108 formed on the corner of the other side panel 22.

Figure 2:
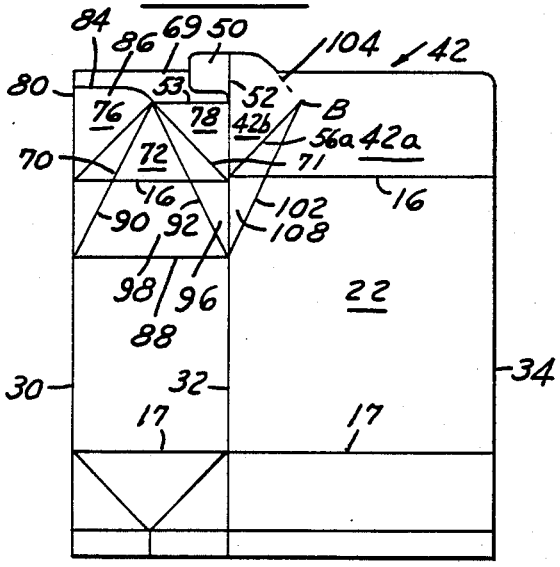
FIG. 2 is a layout view of the outside surface of a blank after it is side seamed from the blank illustrated in FIG. 1.

The container blank 10 illustrated in FIG. 1 is formed into a side seamed blank, as illustrated in FIG. 2, by rotating the body panel 24 and the side seam flap 26 as a unit about the vertical score line 34, and having the inside surfaces of the body panels 24 and 26 come into contact with the inside surface of the body panel 22. The body panel 18 is then rotated about the vertical score line 30 to bring its inside surface into contact with the outside surface of the side seam flap 26, and the edge 28 is positioned parallel and substantially aligned with the vertical score line 36. The various members of the end closures 12 and 15 will make similar movements, and the upper end of the container will appear as illustrated in FIG. 2. The container blank 10 is then sealed where the inside areas of the body panel 18 and the enclosure panel 40 come into contact with the outside surface of the side seam flap 26 and its extension 48.

Figure 3:
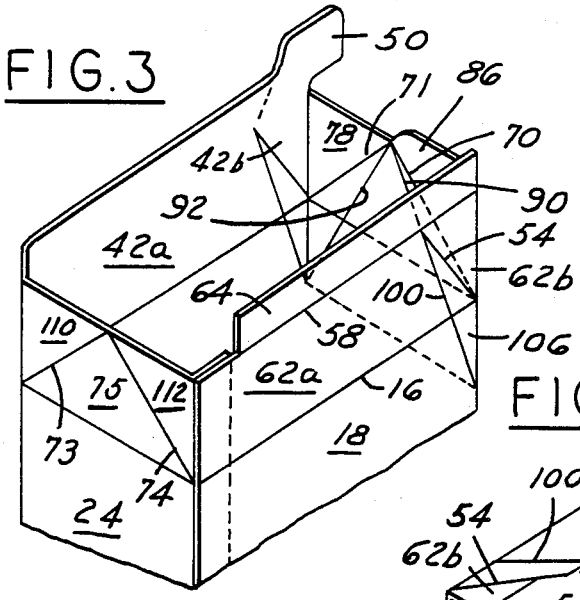
FIGS. 3 and 4 are fragmentary perspective views illustrating sequentially various steps in forming the flat top end closure.
Figure 4:
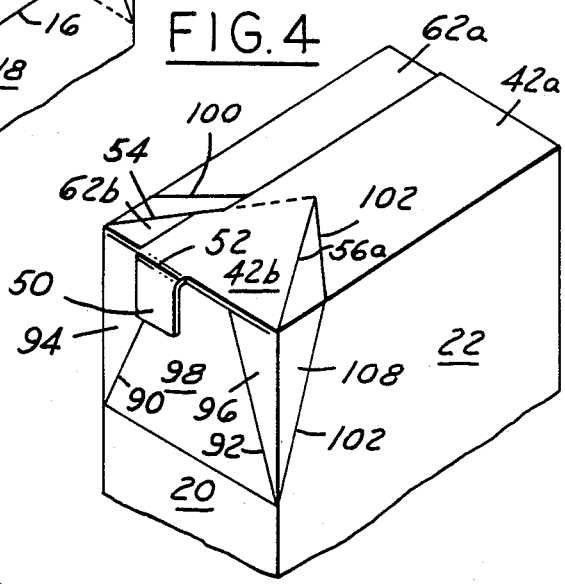

The next steps in forming the side seam blank into a container are illustrated in FIGS. 3 and 4. The side seamed blank is opened up into a squared or rectangular tubular condition, after which the various parts of the end closure 12 are folded about the various score lines in the following manner. Closure panels 72 and 75 are moved around the horizontal score line 16 over the end of the container toward each other. At the same time, the outer closure panels 40 and 42 are also caused to move toward each other about the horizontal score line 16. This causes the fold-back panel portion 76 to bend around the vertical score line 30 and the diagonal score line 70 such that the inside surfaces of the panel portion 76 and the outer panel 40 are approaching each other. Concurrently, the panel portion 78 is moved around the vertical score line 32 and the diagonal score line 71 such that the inside surfaces of the panel portion 78 and the panel 42 are approaching each other. The outside surfaces of the two fold-back panel portions 76 and 78 also approach the outside of the triangular panel 72. The fold-back panel portions 110 and 112 adjacent the triangular panel 75 and having a free cut edge 114, make the same movements as described for the panel portions 76 and 78, with respect to their adjacent panels 42 and 75 and 40 an 75 respectively.

Figure 5:
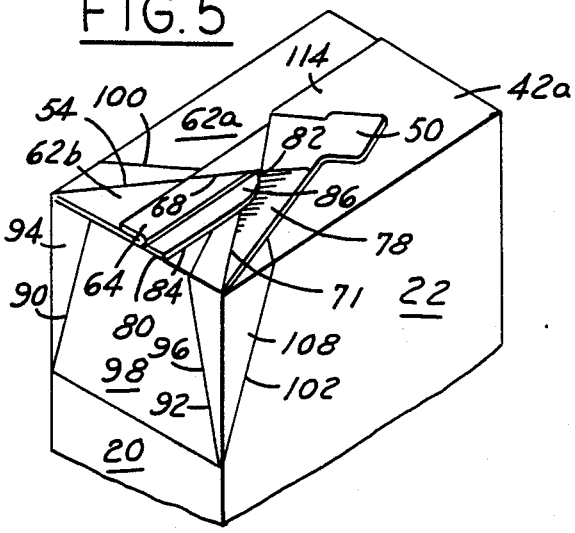
FIG. 5, 6, and 7 are fragmentary perspective views illustrating sequentially various steps in opening the flat top end closure.

The shorter outer closure panel 40 and the adjacent fold-back panels 76 and 112 are caused to move just enough faster than the longer outer panel 42 and the adjacent fold-back panels 78 and 110 such that the panel combination 40/76/112 is flattened before the overlying panel combination 42/78/110. The result, as evident in FIGS. 5 and 6, is that an edge portion !16 of the outer panel 42 overlaps and is sealed to the panel segment 64 which has been folded over onto the outer panel 40, and the edge portion 118 of the fold-back panel 78 overlaps and is sealed to the lift tab 86 of the panel 76.

The lift tab 50 (FIG. 4) may be bent downwardly about the score line 52 and sealed against the front panel 20 to accommodate shipping and stacking.

Figure 6:
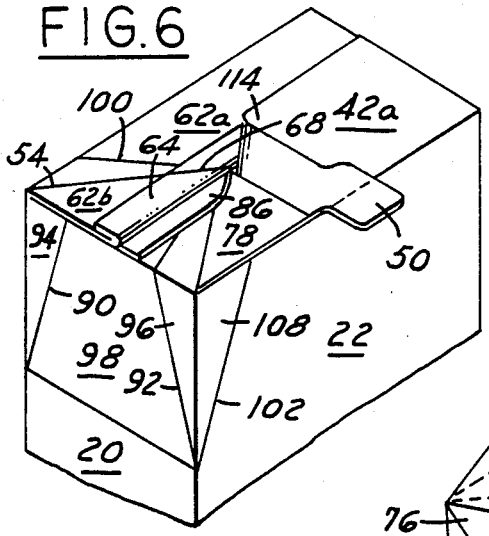
Figure 7:
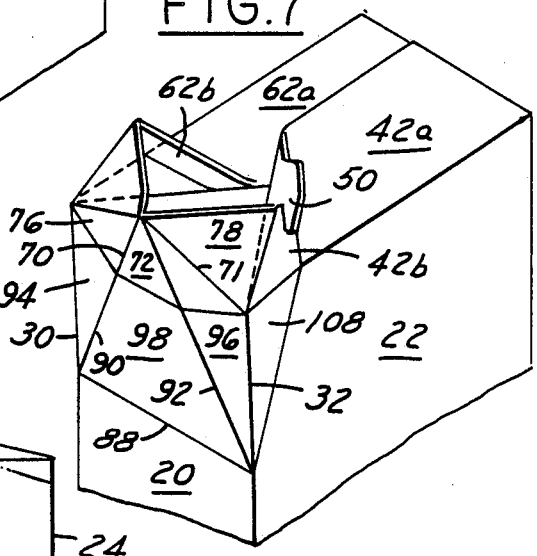
Figure 8:
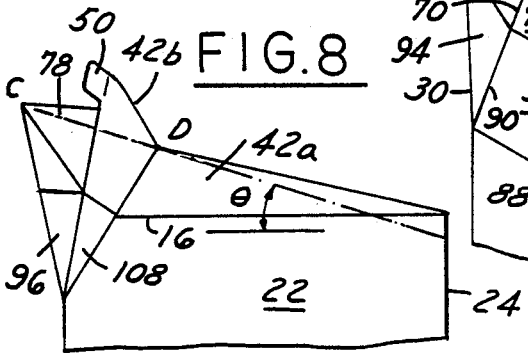
FIG. 8 is a fragmentary side view illustrating the end closure in a full open condition.
Figure 10:
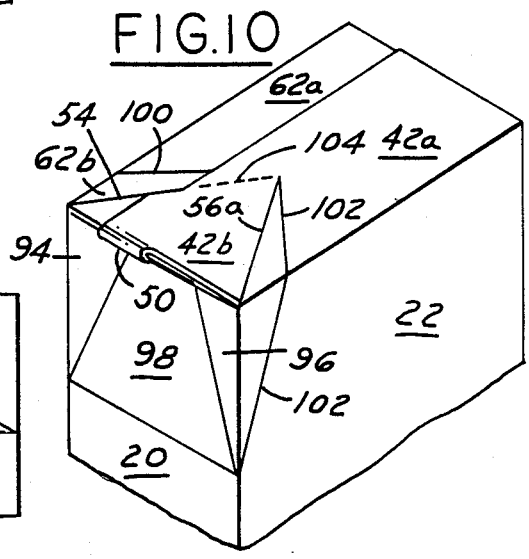
FIG. 10 is a fragmentary perspective view similar to FIG. 4, showing the top closure in a reclosed condition after having been opened.

Referring now to FIG. 6, it may be noted that opening of the flat top closure is effectuated by first releasing the lift tab 50 from the front body panel 20 and then using the released tab to lift the panel segment 42*b* and the underlying panel portion 78 about the respective diagonal score line 71. This exposes the underlying portion of the fold-over panel 64 such that one may grasp and lift the lift tab 86 formed by the edge portion of the panel 76, as defined by the edges 80, 82 and 84. Lifting the tab 86 serves to initially lift the panel segments 76 and 62*b* about the respective diagonal score lines 70 and 71. Further lifting of the tab 86 results in fully opening the pour spout sown in FIG. 7 as follows: the panel portions 72, 76, 78, 94, 96 and 98 of the panel 44 and the adjacent front panel 20 are caused to assume a substantially planar attitude, whereupon pressure against the vertical edge score lines 30 and 32 tends to cause the triangular panel segment formed by segment 98 and the central portion of segment 72 to extend outwardly. However, in lieu of applying pressure to the edge score lines 30 and 32, the lift tab 86 may be used to lift the panel segments 76 and 94 and, hence, the triangular panel portion 98 and the panel segments 78 and 96 up into a planar attitude and then beyond, into the usual pitcher pour spout for dispensing the contents of he container. As a natural result of the longer pouring spout extending down to the horizontal score line 88 on the front panel 20, the outer closure panels 42*a* and 62*a* extend upwardly from the score line 16 at the top edge of the back panel 24, as shown in FIG. 8. The pour spout may, of course, be generally reclosed and "locked" after use, as shown in FIG. 10.

Industrial Applicability

Figure 9:
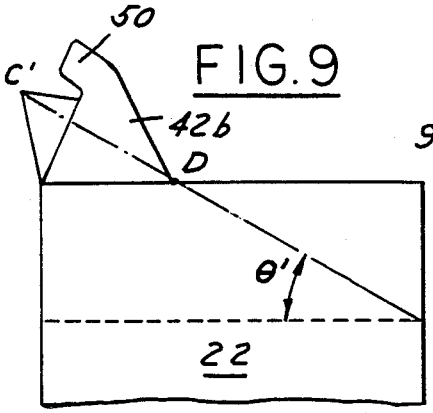
FIG. 9 is a fragmentary perspective view similar to FIG. 8, showing a prior art arrangement thereof.

It maybe noted by comparing angle 0 of a line from horizontal through the points C and D of FIG. 8 with the prior art angle 0' of a line from horizontal through the points C' and D' of FIG. 9 that, once fully opened, there results a substantially less severe carton tilt angle, as well as a more effective venting means when pouring the contents from the container. Head space, or the air volume above the liquid level, is effectively reduced, improving chemical stability of the product.

It is apparent that the flat top closure of the invention includes a pouring spout arrangement which utilizes one set of short diagonal score lines to facilitate closing the carton, and a second set of diagonal score lines to form a longer, more efficient pouring spout once the carton is opened.

While but one embodiment of the invention has been shown and described, other modifications thereof are possible within the scope of the following claims.

The embodiments of the invention in which an exclusive property or privilege is claimed are defined as follows:

1. On a flat top end closure for a liquid carrying paperboard container including a tubular body having one front, one back, and two side wall panels; said one front panel being connected to said two side wall panels by respective vertical score lines; a bottom end closure; and a flat top end closure having two outer closure panels connected to said two side wall panels, and two fold-in panels respectively connected to said one front and one back wall panels, the one of said two fold-in panels is connected to the front wall panel serves as part of a pouring spout, the one of said two fold-in panels including a first triangular panel having an apex and secured to the front wall panel and two adjacent fold-back panels on opposite sides of the first triangular panel, the improvement comprising a horizontal score line formed across said one front wall panel between said respective vertical score lines and a predetermined distance below said first triangular panel, two diagonal score lines extending from said horizontal line at said respective vertical score lines to the apex of said first triangular panel, and two additional diagonal score lines extending from said horizontal score line at said respective vertical score lines upwardly across said side wall panels, and then across said two outer closure panels.

2. A pouring spout arrangement for a liquid carrying paperboard container having front, back and two side wall panels, front and back fold-in panels, and two overlying outer closure panels, said front fold-in panel including a central triangular panel segment having an apex and two adjacent fold-back panel segments, said pouring spout arrangement comprising a score line arrangement formed on said front wall panel and on said front fold-in panel whereby said front wall panel assumes, in its open position, respective co-planar relationships with three portions of said central triangular panel segment to elongate the resultant pouring spout, said three portions being connected to each other by said score line arrangement.

3. A pouring spout arrangement for a liquid carrying paperboard container having front, back and two side wall panels interconneted by vertical score lines, front and back fold-in panels, and two overlying outer closure panels, said front fold-in panel including a central triangular panel segment having an apex and two adjacent fold-back panel segments, said pouring spout arrangement comprising a score line arrangement formed on said front wall and on said front fold-in panel whereby said front wall panel assumes, in its open positions of said central triangular panel segment to elongate the resultant pouring spout, wherein said score line arrangement includes a horizontal score line formed across said front wall panel between vertical score lines, and two diagonal score lines extending from said horizontal score line at said vertical score lines to the apex of said central triangular panel segment.

4. A pouring spout arrangement for a liquid carrying paperboard container having front, back and two side wall panels, front and back fold-in panels, and two overlying outer closure panels, said front fold-in panel including a central triangular and two adjacent fold-back panel segments, said pouring spout arrangement comprising score line means formed on said front wall panel and on said front fold-in panel whereby said front wall panel assumes, in its open position, respective co-planar relationship with portions of said central triangular and two adjacent fold-back panel segments to elongate the resultant pouring spout, said score line means including a horizontal score line formed across said front wall panel, and two diagonal score lines extending from the ends of said horizontal score line to the apex of score said central triangular panel segment, and two diagonal opening-assist score lines extending from said horizontal score line upwardly across only said two side wall panels and said two outer closure panels.

* * * * *